US007159728B2

(12) United States Patent
Smith

(10) Patent No.: US 7,159,728 B2
(45) Date of Patent: Jan. 9, 2007

(54) BRAIDING/WEAVING HAIR AND BEAUTY SUPPLY STAND

(76) Inventor: Brenda A. Smith, 16138 Five Points, Detroit, MI (US) 48240

( * ) Notice: Subject to any disclaimer, the term of this patent is extended or adjusted under 35 U.S.C. 154(b) by 60 days.

(21) Appl. No.: 10/962,387

(22) Filed: Oct. 8, 2004

(65) Prior Publication Data

US 2005/0109367 A1 May 26, 2005

Related U.S. Application Data

(60) Provisional application No. 60/510,377, filed on Oct. 9, 2003.

(51) Int. Cl.
*A47F 5/08* (2006.01)

(52) U.S. Cl. ..... 211/166; 211/115; 211/70; 211/205; D28/10; D28/92; D6/457

(58) Field of Classification Search ..... 211/166, 211/67, 115, 70, 61, 85.2, 133.4, 205, 70.6, 211/131.1, 58, 130.1, 78; D28/10, 92, 76; D6/460, 457

See application file for complete search history.

(56) References Cited

U.S. PATENT DOCUMENTS

| | | | | | |
|---|---|---|---|---|---|
| 321,624 | A | | 7/1885 | McPherson | |
| 874,933 | A | * | 12/1907 | Bristow | 211/77 |
| 978,670 | A | | 12/1910 | Solomon | |
| D48,739 | S | * | 3/1916 | Sommerville | D6/457 |
| 1,221,517 | A | | 4/1917 | Dunbar | |
| D56,084 | S | * | 8/1920 | Thomsen | D6/457 |
| D113,705 | S | | 3/1939 | Di Simone | |
| 2,318,081 | A | | 5/1943 | Kerry | 211/13 |
| D175,300 | S | | 8/1955 | Farbush | D33/8 |
| D195,072 | S | | 4/1963 | Kolarik | D86/10 |
| 3,282,439 | A | | 11/1966 | Vitale | 211/131 |
| 3,314,177 | A | | 4/1967 | Mies, Jr. et al. | 40/124 |
| D216,450 | S | | 1/1970 | Chiarello | D80/9 |
| 3,613,901 | A | | 10/1971 | Montelius | 211/166 |
| 3,715,038 | A | | 2/1973 | Winkler | 211/128 |
| 3,862,735 | A | * | 1/1975 | Cohen | 248/405 |
| D243,992 | S | | 4/1977 | Baxter | D7/74 |
| 4,070,973 | A | * | 1/1978 | Morgan | 108/20 |
| 4,250,666 | A | * | 2/1981 | Rakestraw | 47/83 |
| 4,380,296 | A | | 4/1983 | Murray et al. | 209/704 |
| 4,534,471 | A | | 8/1985 | Zahn et al. | 211/39 |
| 4,549,664 | A | | 10/1985 | Gowan et al. | 211/131 |
| 4,763,855 | A | | 8/1988 | DiVincenzo | 242/139 |
| D300,266 | S | | 3/1989 | Lane | D28/11 |
| 4,884,701 | A | * | 12/1989 | Nymark et al. | 211/69.8 |
| D330,982 | S | | 11/1992 | Braun | D6/457 |

(Continued)

*Primary Examiner*—Richard E. Chilcot, Jr.
*Assistant Examiner*—Lindsay M. Maguire
(74) *Attorney, Agent, or Firm*—Rohm & Monsanto, PLC

(57) ABSTRACT

A support arrangement for a hair styling salon has a stanchion for forming a substantially central support member for an annular rim member. The annular rim member has notches along its periphery for accommodating respective skeins of braiding/weaving hair. Each notch is dimensioned to grasp a respective skein of braiding/weaving hair. A radial support arrangement configured as spokes that extend radially from the stanchion supports the annular rim member rotatably and removably on the stanchion. A tray is concentrically disposed with respect to the annular rim member and is vertically adjustably supported on the stanchion. The tray supports beauty products and implements, such as needles and thread, that are used during the braiding/weaving process. An elastomeric portion is annularly configured and arranged to overlie the annular rim, and has a plurality of slit-like notches that grasp resiliently and securely respective skeins of braiding/weaving hair.

5 Claims, 3 Drawing Sheets

U.S. PATENT DOCUMENTS

| | | | | | |
|---|---|---|---|---|---|
| D348,999 | S | | 7/1994 | Bonazza | D6/486 |
| 5,487,600 | A | * | 1/1996 | Griffin | 312/135 |
| 5,676,261 | A | * | 10/1997 | Baughman et al. | 211/70 |
| D395,182 | S | | 6/1998 | Singleton | D6/469 |
| 5,894,944 | A | | 4/1999 | Swift | 211/78 |
| D454,722 | S | | 3/2002 | Novel | D6/415 |

* cited by examiner

BRAIDING/WEAVING HAIR AND BEAUTY SUPPLY STAND

RELATIONSHIP TO OTHER APPLICATION

This application claims the benefit of the filing date of Provisional Patent Application Ser. No. 60/510,377 filed Oct. 9, 2003, the contents of which are incorporated herein by reference.

BACKGROUND OF THE INVENTION

1. Field of the Invention

This invention relates generally to hair styling stands and trolleys, and more particularly, to a stand or trolley that supports a plurality of skeins of hair for braiding or weaving in a hair styling salon.

2. Description of the Related Art

Hair stylists that perform hair braiding or weaving procedures generally have no secure place to lay skeins of natural or artificial hair that will be used in the procedure. It is not uncommon for the stylists to lay the skeins on the backs of chairs or in wash sinks. In addition to causing delay in the progress of the braiding or weaving procedure, bacteria or dirt may be deposited on the skeins of hair prior to their being installed.

There is a need, therefore, for an arrangement that securely supports skeins of hair during the braiding or weaving procedure, and that affords a convenient place for the stylist to obtain the skeins of hair during the procedure. The increased efficiency that would result from convenient placement of the skeins of hair during the braiding or weaving procedure would be particularly beneficial for children customers who generally do not have the patience required to sit quietly through the prolonged procedures, often requiring several hours. Of course, shortening the duration of the procedures will improve customer throughput in the hair styling salon, with a corresponding increase in revenue.

SUMMARY OF THE INVENTION

The foregoing and other objects are achieved by this invention which provides a support arrangement for a hair styling salon. In accordance with the invention, there is provided a stanchion for forming a substantially central support member for an annular rim member. The annular rim member has a plurality of notches along its periphery for accommodating respective skeins of braiding/weaving hair. Each notch is dimensioned to achieve a snug grasp of the respective skein of braiding/weaving hair. There is additionally provided a radial support arrangement for supporting the annular rim member on the stanchion. The radial support arrangement is, in a specific illustrative embodiment of the invention, configured as spokes that extend radially from the stanchion. A tray is concentrically disposed with respect to the annular rim member and supported on the stanchion. The tray is used to support beauty products that are useful during the braiding/weaving process.

In a specific illustrative embodiment of the invention, the annular rim has an elastomeric portion. The elastomeric portion preferably is annularly configured and arranged to overlie the annular rim. A plurality of slit-like notches are disposed on the elastomeric portion, and serve to grasp respective skeins of braiding/weaving hair.

In a further embodiment, the slit-like notches on the elastomeric portion accommodate the respective skeins of braiding/weaving hair resiliently. This provides security that the skeins of braiding/weaving hair will not inadvertently be released onto the floor of the hair styling salon.

BRIEF DESCRIPTION OF THE DRAWING

Comprehension of the invention is facilitated by reading the following detailed description, in conjunction with the annexed drawing, in which.

DETAILED DESCRIPTION

Figure 1:
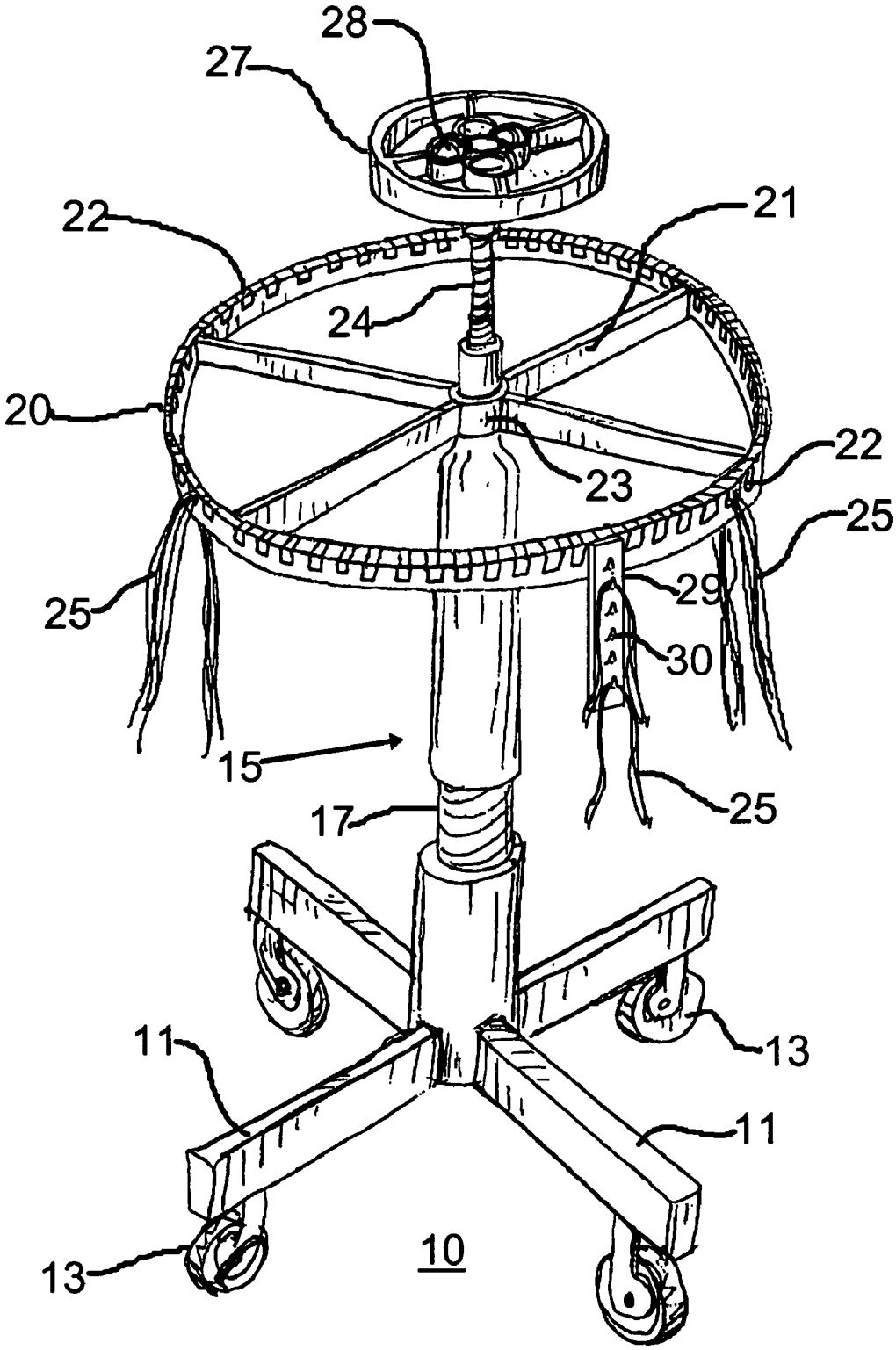
FIG. 1 is an isometric representation of a specific illustrative embodiment of the invention.

FIG. 1 is an isometric representation of a specific illustrative embodiment of the invention. As shown, hair braiding/weaving stand 10 is shown to be supported on orthogonal leg supports 11, each of which has an associated wheel 13. Wheels 13 may be provided with a braking arrangement to preclude inadvertent rolling away of the hair braiding/weaving stand.

Centrally disposed on orthogonal leg supports 11 is a stanchion that is vertically oriented and designated generally as 15. Stanchion 15 in this specific illustrative embodiment of the invention is provided with a height adjustment arrangement 17. The height adjustment arrangement is shown in the figure to be a conventional screw lift arrangement, but any other form of lift arrangement, such as a hydraulic or pneumatic system (not shown), may be use in the practice of the invention.

An annular rim member 20 is shown concentrically arranged, in this embodiment, about stanchion 15. The annular rim is connected to the stanchion by a plurality of spoke members 21 that, in this specific illustrative embodiment of the invention, are all joined to a collar 23 that permits the annular rim and the spoke members to be rotatable about the stanchion.

The annular rim is shown to have a plurality of notches 22 disposed therearound. the notches serve to hold a corresponding plurality of skeins of hair 25 in spaced-apart relation. The skeins of hair are intended to be installed on a customer (not shown) by braiding, weaving, or other hair styling technique. This arrangement facilitates the braiding/weaving process and significantly reduces the time required for the installation of the hair onto the customer.

In this specific illustrative embodiment of the invention there is additionally provided a tray support arrangement 24 that supports a tray 27. The tray will support beauty products (not shown) and instruments (not shown) that will be used during the process of installing the skeins of hair onto the customer. Beauty products that are provided in conventional cylindrical containers are securely retained in circular openings 28. The remainder of tray 27 is segmented as shown to maintain the work space organized. Tray support arrangement 24 in this embodiment is a screw-type arrangement that enables the height of tray 27 to be adjusted in relation to the height of annular rim member 20. Moreover, tray 27 and its associated support arrangement 24 can be removed to permit annular rim member 20 and its associated spoke members 21 to be removed or replaced. Thus, a new tray of beauty supplies, or a different annular rim that has been repopulated with skeins of hair, such as in preparation for another client, can be installed on the stanchion during the braiding/weaving process.

In a specific illustrative embodiment of the invention, tray 27, or annular rim member 20, can be provided with a magnetized region, or a holder (not shown), that will retain a braiding or weaving needle (not shown) in convenient relation to the user/stylist (not shown). In addition, the tray and/or the annular rim can be provided with one or more spool holders (not shown) for retaining spools of thread used in the styling process.

There is additionally shown in this specific illustrative embodiment of the invention a longitudinal member 29 that is provided with a plurality of hooks, or protuberances 30. The longitudinal member is arranged to be hung on annular rim member 20 by any known means (not shown). Skeins of hair 25 are draped over protuberances 30, effectively multiplying the capacity of the annular rim member to carry skeins of hair. Preferably, a plurality of longitudinal members 29 are provided and are easily removed from the annular rim member, populated with skeins of hair, and reinstalled, illustratively by a stylist assistant (not shown), to improve the efficiency of the braiding/weaving process being performed by the stylist (not shown) on the client (not shown).

Figure 2:
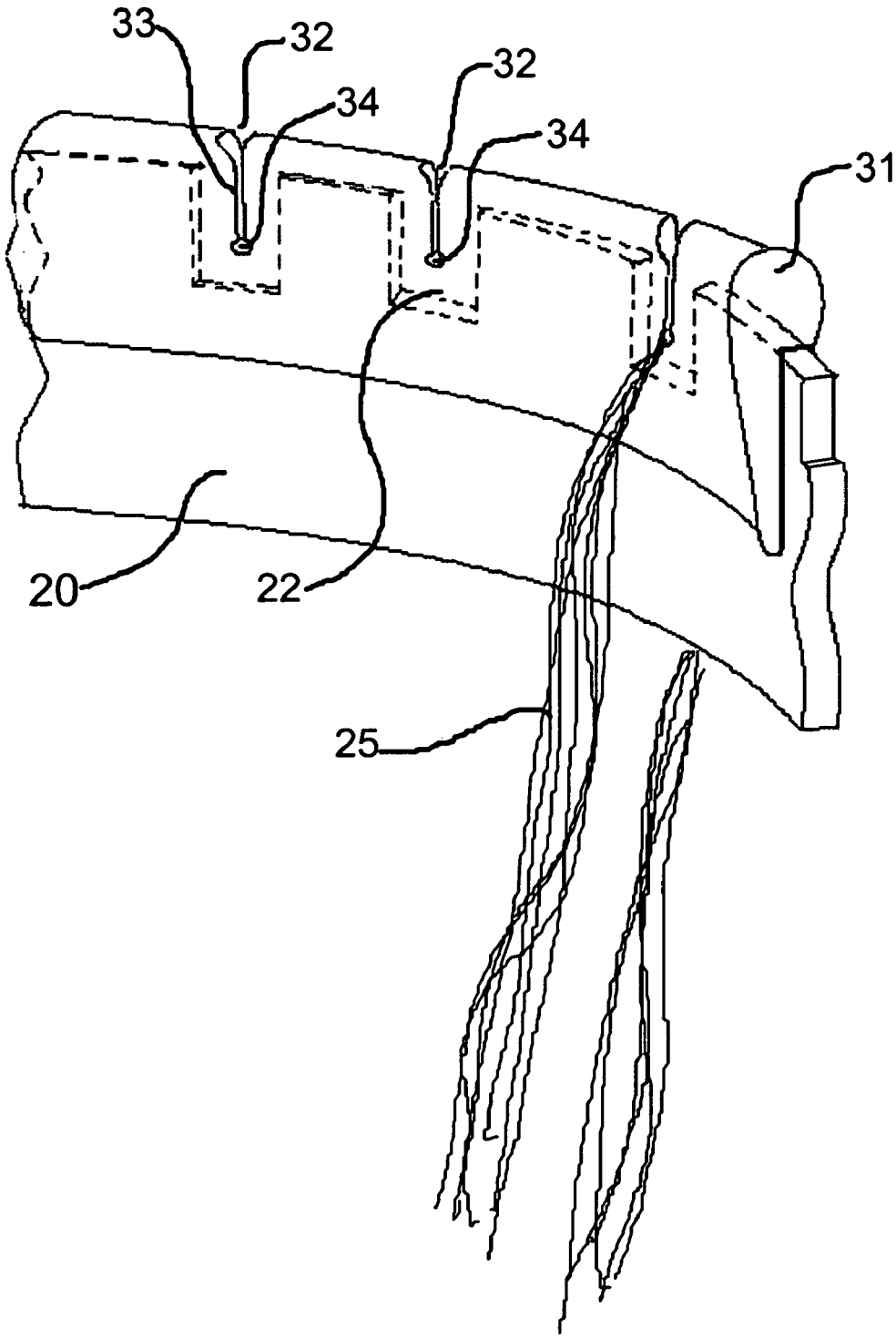
FIG. 2 is a partially fragmented isometric representation of a portion of the embodiment of FIG. 1, further showing an illustrative resilient arrangement for grasping the respective skeins of hair for braiding or weaving.

FIG. 2 is a partially fragmented isometric representation of a portion of annular rim member 20 of FIG. 1. This figure further shows an illustrative resilient arrangement 31 that is provided with notches 32 that, in this specific illustrative embodiment of the invention are registered with notches 22 annular rim member 20. In this specific illustrative embodiment of the invention, notches 32 lead to respective ones of slits 33, each of which terminates in a respective slit termination 34. The slit structure in resilient arrangement 31 grasps the respective skeins of hair 25 securely for subsequent braiding or weaving.

Installation of the skeins of hair 25 in resilient arrangement 31 is easily achieved by merely urging each skein of hair transversely through a respective notch 32, along associated slit 33, until the skein of hair is disposed in slit termination 34.

Figure 3:
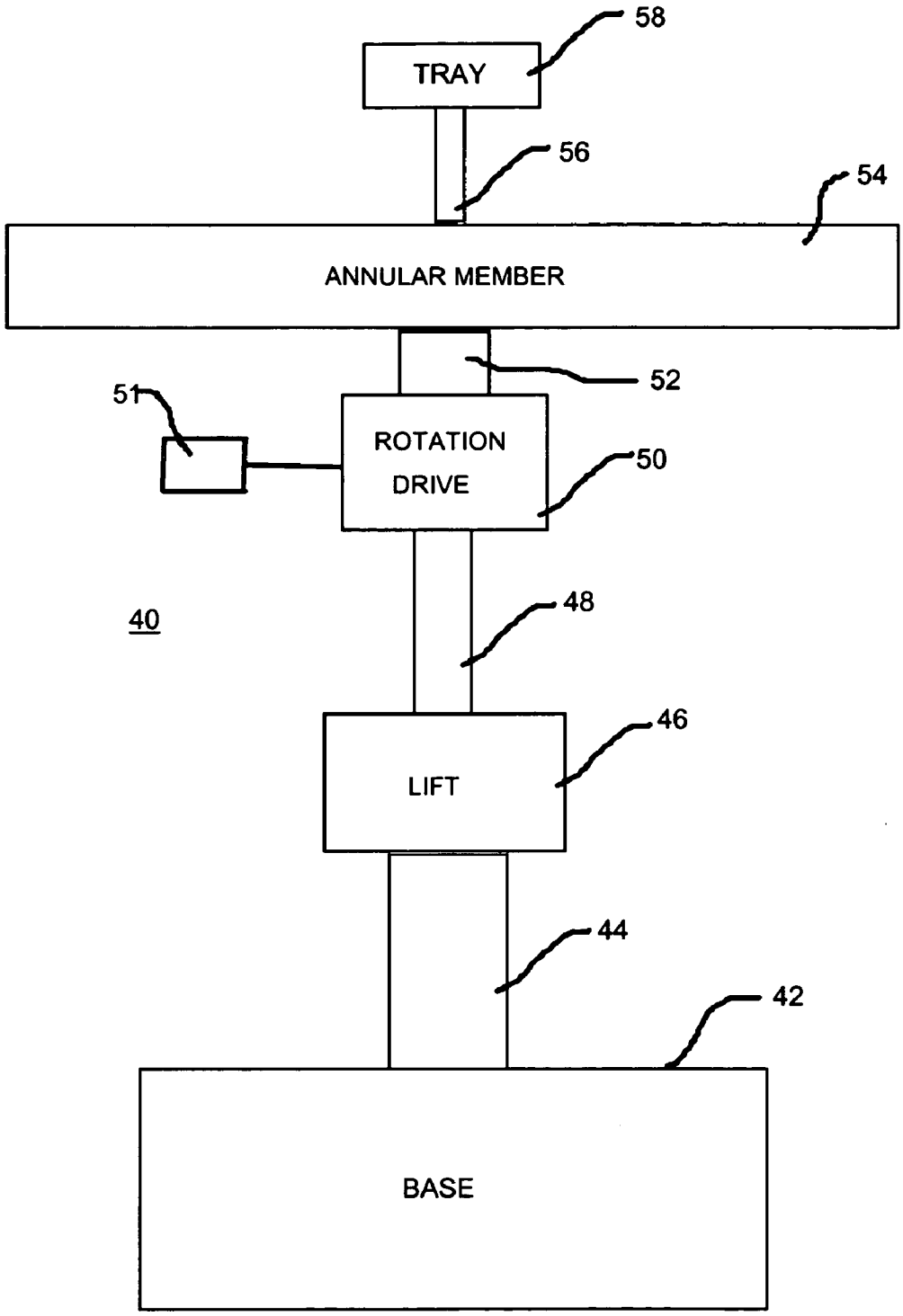
FIG. 3 is a schematic representation of a further specific illustrative embodiment of the invention.

FIG. 3 is a schematic representation of a further specific illustrative embodiment of the invention. As shown in this figure, hair braiding/weaving stand 40 is provided with a base 42 that, as described hereinabove, may be provided with wheels (not shown in this figure) that facilitate its being moved in the styling salon (not shown) at the convenience of the stylist (not shown). A stanchion 44 supports a lift arrangement 46 that allows the overall height of hair braiding/weaving stand 40 to be adjusted, again at the convenience of the stylist. Lift arrangement 46 may be a simple screw-type device, as described hereinabove in relation to FIG. 1, or it may be a hydraulic system or any other known form of lift arrangement.

As shown, lift arrangement 46 is configured to lift a further stanchion member 48 on which, in this specific illustrative embodiment of the invention, is disposed a rotation drive 50. Rotation drive 50 is coupled via a coupler 52 to an annular rim member 54. Preferably, the annular rim member is removable from coupler 52, but when connected thereto, is rotatable in response to the rotatory force applied by rotation drive 50. The rotation drive may be of any known form, and may include, for example, simple rotation at an adjustable speed, or may include an indexing feature responsive to a foot switch 51 that is schematically represented in the figure.

In addition, there is provided a tray support stanchion 56 that supports a tray 58. In some embodiments of the invention, tray support stanchion 56 is configured not to be rotatable with annular rim member 54, so that the tools and supplies thereon (not shown) remain in substantially fixed relation to the stylist. Nevertheless, tray 58 is preferably arranged to be removable from hair braiding/weaving stand 40 to facilitate it being repopulated with tools and supplies that are to be used in a subsequent hair styling process, or client (not shown).

Although the invention has been described in terms of specific embodiments and applications, persons skilled in the art may, in light of this teaching, generate additional embodiments without exceeding the scope or departing from the spirit of the invention described herein. Accordingly, it is to be understood that the drawing and description in this disclosure are proffered to facilitate comprehension of the invention, and should not be construed to limit the scope thereof.

What is claimed is:

1. A support arrangement for a hair styling salon, the hair styling salon having a floor, the support arrangement comprising:

a stanchion for forming a substantially central support;

an annular rim member having a plurality of notches along its periphery for accommodating removably respective skeins of braiding/weaving hair;

a radial support arrangement for supporting said annular rim member on said stanchion;

a tray concentrically disposed with respect to said annular rim member and supported on said stanchion;

a base member for supporting said stanchion in a vertical orientation with respect to the floor of the hair styling salon;

a lift arrangement disposed in said stanchion for adjusting a height dimension of said annular rim member in relation to said base member;

a plurality of wheels coupled to said base member for facilitating movement of said stanchion along the floor of the styling salon; and a brake arrangement coupled to at least one of said plurality of wheels for maintaining said stanchion in substantially fixed location on the floor of the styling salon as the skeins of braiding/weaving hair are accommodated in, and removed from, the notches of said annular rim member.

2. The support arrangement of claim 1, wherein said annular rim member has an elastomeric portion, the plurality of notches being disposed on said elastomeric portion.

3. The support arrangement of claim 2, wherein the notches on said elastomeric portion accommodate the respective skeins of braiding/weaving hair resiliently.

4. The support arrangement of claim 1 wherein said annular rim member is rotatable with respect to said stanchion.

5. The support arrangement of claim 4 wherein there is further provided a rotatory drive arrangement for rotating said annular rim member with respect to said stanchion.

* * * * *